US006545576B1

(12) United States Patent
Marchini et al.

(10) Patent No.: US 6,545,576 B1
(45) Date of Patent: Apr. 8, 2003

(54) SWITCH ASSEMBLIES

(75) Inventors: Barry Allen Marchini, Surrey (GB); Dov Liam Randall, Manchester (GB)

(73) Assignee: Starpoint Electrics Limited and Barcrest Limited, Surrey (GB)

( * ) Notice: Subject to any disclaimer, the term of this patent is extended or adjusted under 35 U.S.C. 154(b) by 0 days.

(21) Appl. No.: 09/424,271

(22) PCT Filed: May 21, 1998

(86) PCT No.: PCT/GB98/01462

§ 371 (c)(1),
(2), (4) Date: Dec. 13, 1999

(87) PCT Pub. No.: WO98/53472

PCT Pub. Date: Nov. 26, 1998

(30) Foreign Application Priority Data

May 21, 1997 (GB) ..... 9710467

(51) Int. Cl.[7] ..... H01H 9/00
(52) U.S. Cl. ..... 335/205
(58) Field of Search ..... 335/151–154, 335/205–208

(56) References Cited

U.S. PATENT DOCUMENTS 3,678,425 A * 7/1972 Holmes, Jr. ..... 335/207
4,680,682 A * 7/1987 Parker ..... 362/158
5,668,533 A * 9/1997 Jackson, Jr. et al. ..... 340/547

FOREIGN PATENT DOCUMENTS

| | | |
|---|---|---|
| DE | 209 541 A | 5/1984 |
| DE | 247 102 A1 | 6/1987 |
| GB | 2 223 831 A | 4/1990 |
| WO | WO 96/29717 A1 | 9/1996 |

* cited by examiner

*Primary Examiner*—Ramon M. Barrera
(74) *Attorney, Agent, or Firm*—Sughrue Mion, PLLC

(57) ABSTRACT

A switch assembly, which is particularly suitable for use in a fruit machine, is constituted by a front part (5) to be located by an outer face of a glass panel (52) and a rear part (54) to be located by a an inner face of the glass panel (52) with the front and rear parts of the switch assembly being operably connected by magnets allowing the glass panel (52) to extend continuously therebetween, thereby avoiding the need to form a hole in the glass panel (52) and with the front part (50) including two magnets (66) which are arranged with their poles facing in opposite directions perpendicularly to the length of a reed switch (56) carried by the rear part (54) and which are displaced non-linearly with respect to the reed switch (56) as the front part (50) is rocked about a pivot (62).

11 Claims, 3 Drawing Sheets

SWITCH ASSEMBLIES

BACKGROUND OF THE INVENTION

The present invention relates to switch assemblies and is more especially but not exclusively concerned with switch assemblies for use with so-called fruit machines.

A fruit machine is typically provided with a series of switch assemblies which are operated by a player of the fruit machine to enable the player to control various functions of the fruit machine such as start, hold, reel nudge, etc.

A switch assembly is typically provided with a push button which is movable within a surrounding bezel forming a front part of a switch mounting with a rear part of the switch mounting including an externally threaded tube carrying a microswitch such that pressing the push button operates the microswitch.

The bezels of different switch mountings can be of a different shape and colour, to indicate different functions to be controlled, but the threaded tubes of different switch mountings can all be the same.

In order to allow the switch assembly to be secured to the fruit machine it is first necessary to form a hole in a panel of the fruit machine.

The dimensions of the hole are such as to allow passage of the rear part of the switch mounting therethrough but not to allow passage of the front part of the switch mounting therethrough. The switch mounting can thus be inserted into the hole until the bezel of the switch mounting abuts a front (outer) face of the panel and the threaded tube of the switch mounting projects from a rear (inner) face of the panel.

Finally, an internally threaded part, such as a simple lock nut, is screwed along the threaded tube until the panel is firmly sandwiched between the bezel and the lock nut.

There are significant practical disadvantages in this known procedure.

One disadvantage is that drilling the hole in the panel might cause the panel to crack, or split, particularly if the panel is a glass or plastics panel. The hole will always be a point of weakness in the panel. Moreover, a number of holes are necessary if a series of switch assemblies are to be secured to the panel. Clearly, the likelihood of the panel being damaged increases as the number of holes to be drilled in the panel increases. The loss in replacing a damaged panel is thus not just the value of the panel but also the time and effort wasted in drilling any other holes in the panel which were satisfactory.

Other disadvantages of the presence of a hole in the panel are that it facilitates unauthorised access to the inside of the fruit machine, determines exactly where the switch assembly is to be mounted on the fruit machine, and may allow entry of liquid or moisture to the inside of the fruit machine.

Any or all of these disadvantages are also found in other applications. For example, liquid may be spilt in a kitchen and it would be desirable to prevent the liquid coming into contact with an electrical circuit, such as in a switch for a cooker hob. Furthermore, steam is often to be found in a bathroom and it would be desirable to prevent the steam coming into contact with an electrical circuit, such as in a switch for a mirror light. There are clearly many different situations in which switch assemblies run the risk of coming into contact with liquid or moisture.

SUMMARY OF THE INVENTION

According to a first aspect of the present invention, a switch assembly comprises a front part to be located by a panel face and a rear part to be located by an opposed panel face, characterised in that the front and rear parts of the switch assembly are operably connected by magnetic means allowing the panel to extend continuously therebetween.

It will be appreciated that, in a preferred embodiment, the panel is present and is part of a fruit machine.

The fruit machine may include a series of the switch assemblies, with the switch assemblies being operable to control different functions, and the panel may be a glass or plastics panel.

Preferably, the front part of the switch assembly still includes a push button which is movable within a surrounding bezel.

However, instead of a mechanical connection between the push button and a microswitch, movement of the push button now preferably displaces a magnet, or indeed a plurality of magnets, to cause operation of a reed switch carried by the rear part of the switch assembly.

The arrangement should be such that when the push button is depressed the magnet(s) are displaced to position (s) causing the reed switch to adopt a first operative condition, whereas when the push button is released the magnet(s) are returned to position(s) causing the reed switch to adopt a second operative condition.

The displacement of the magnet or each of the magnets can be a linear displacement sequentially towards and away from the reed switch.

A comparatively deep bezel may be needed to accommodate the length of travel of the push button needed for a sufficient vertical displacement of the magnet. Similarly, a comparatively long bezel may be needed to accommodate the length of travel of the push button needed for a sufficient horizontal displacement of the magnet. It may be preferable for aesthetic reasons if the need for comparative deep or long bezels could be avoided.

It is believed that there are many situations, other than in fruit machines, where it has hitherto been necessary to provide a comparatively obtrusive mechanism to ensure sufficient travel of the magnet or magnets.

According to a second aspect of the present invention, a switch assembly comprises a magnet which is displaceable relatively to a reed switch, characterised in that the magnet is constrained to be displaced non-linearly to cause operation of the reed switch.

Preferably, the magnet is turned relatively to the reed switch whilst remaining at a substantially constant linear spacing from the reed switch—the degree to which the magnet needs to be turned to operate the reed switch may depend upon the particular circumstances.

In situations where it is still desirable to provide a button to be pushed rather than a knob to be turned, such as in a fruit machine, a linear displacement of the push button could be converted into a turning movement of the magnet by conversion means.

In a particularly preferred arrangement, the conversion means could be a collapsible component having a first portion connected to the push button and a second portion connected to the magnet, the first and second portions being connected to each other by a plurality of slanted resilient vanes which cause the magnet to twist relatively to the push button when the distance between the first and second portions is reduced by depressing the push button, and cause the magnet and the push button to be returned to their original positions when the push button is released.

The conversion means may, however, take many other forms and is not to be regarded as being restricted to a resiliently collapsible and twistable one-piece component.

For example, rather than rely on the resilient nature of the component to return the push button when the push button is released, a separate compression spring may be provided.

Moreover, the first and second portions of the conversion means need not be integrally formed but could merely be interconnected. The first and second portions may be shaped to function like a spinning top, with the first portion presenting a follower and the second portion presenting a helically advancing guide, such as a groove, which is rotated when the follower is linearly displaced. More generally, the first portion could be provided with one or more linearly displaceable cam surfaces, such as a wedge or thread, which interconnect with one or more complementary cam surfaces on the second portion, such as another wedge or thread, to cause the second portion to rotate as the first portion is linearly displaced.

As yet another example, the first and second portions of the conversion means need not even be directly interconnected—here, the spring itself may be arranged such that, when compressed, it causes the first and second portions of the conversion means to turn relatively to one another.

In practice, if there is a single rotatable magnet it needs to be located centrally of the reed switch and this can cause an undesirable central shadow if the push button is to be illuminated.

However, the effect of a central shadow can be avoided if the magnet is rocked relatively to the reed switch, rather than being turned, such a rocking movement having been found to be still effective to operate the reed switch, particularly if two or more of the magnets are provided.

According to a third aspect of the present invention, a switch assembly comprises front and rear parts, characterised in that the front and rear parts are physically separate and the front part is provided with a plurality of magnets whose displacement causes operation of a reed switch carried by the rear part.

It has been found that if twin magnets are provided with their poles facing in opposite directions, perpendicularly to the length of the reed switch, the reed switch can be operated in a reliable manner, with linear movement or even with the limited degree of travel given by a rocking movement.

It is believed that the decrease in the hysteresis (lagging of magnetic induction behind magnetising force), compared with the hysteresis associated with a bar magnet arranged parallel to the length of the reed switch, results from the existence of a relatively low flux path between the two magnets (such as rare earth magnets) which intensifies as the two magnets approach the reed switch.

BRIEF DESCRIPTION OF THE DRAWINGS

Two switch asswemblies, embodying the present invention, will now be described in more detail, by way of example only, with reference to the accompanying drawings, in which.

DETAILED DESCRIPTION OF PREFERRED EMBODIMENTS

Figure 1:
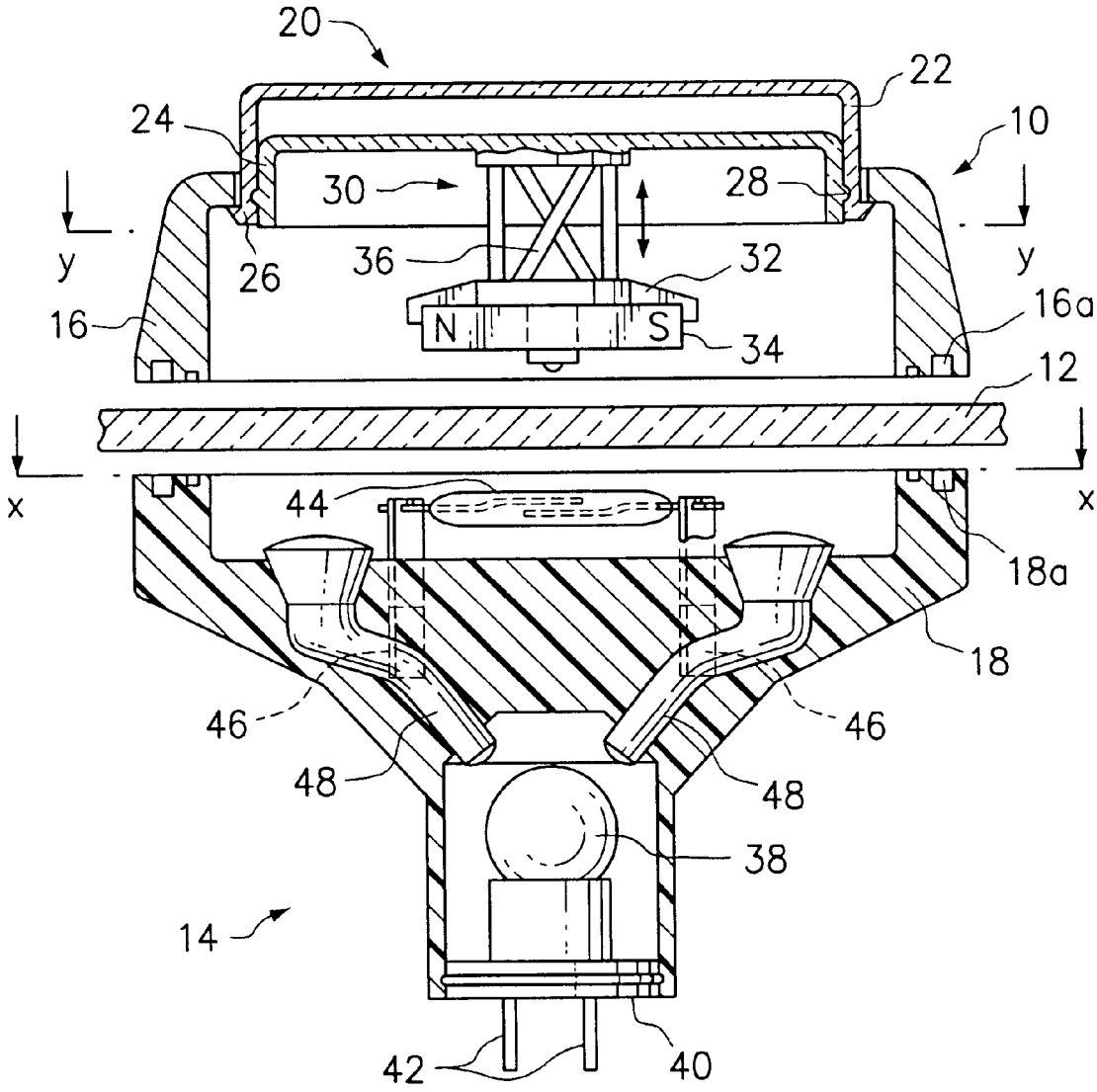
FIG. 1 is a schematic exploded sectional view through a first embodiment.
Figure 2:
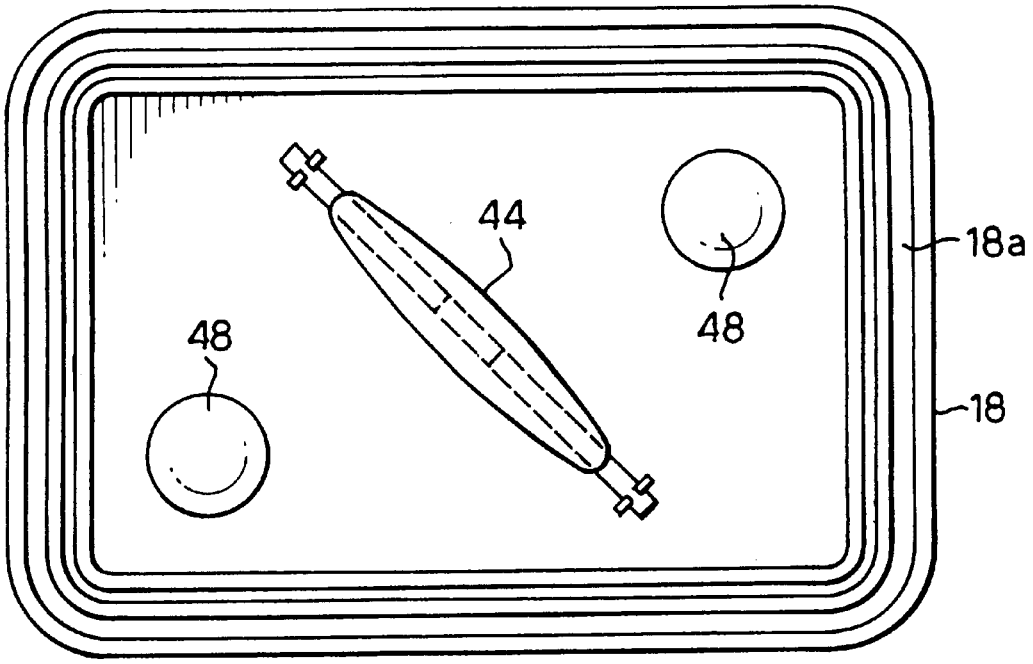
FIGS. 2 and 3 are enlarged schematic cross-sectional views respectively taken along the lines x—x and y—y of FIG. 1.
Figure 3:
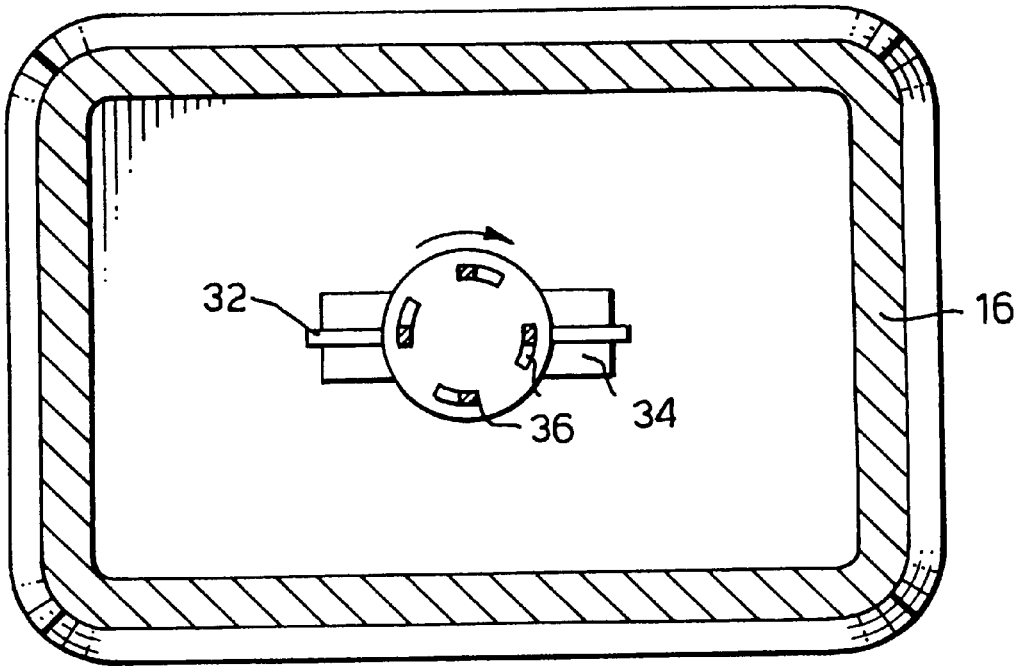

With reference to FIGS. 1 to 3, a switch assembly is shown in two parts, namely a front part 10 located by an outer face of a panel 12 and a rear part 14 located by an inner face of the panel 12.

The panel 12 can, for example, be a glass panel forming part of a fruit machine.

The front part 10 of the switch assembly includes a bezel 16, of predetermined colour and shape, which is secured to the outer face of the panel 12 by an adhesive provided in grooves 16*a*. The rear part 14 of the switch assembly similarly includes a housing 18 which is secured to the inner face of the panel 12 by an adhesive provided in grooves 18*a*. The bezel 16 and the housing 18 may both be formed of a plastics material and may both be, for example, of circular or rectangular peripheral outline.

The bezel 16 surrounds a reciprocally movable push button 20 constituted by a translucent lens cap 22 and a translucent diffuser unit 24. The lens cap 22 is prevented from escaping from the surrounding bezel 16 by an outwardly extending flange 26. The diffuser unit 24 is a snap fit with the lens cap 22 as a result of a rib-and-groove connection 28. One end of a movement conversion component 30 is fixed to the diffuser unit 24, with the other end of the component 30 having a housing 32 for a magnet 34 and pivotally abutting the panel 12. The two ends of the component 30 are connected by a plurality of slanted resilient vanes 36.

The housing 18 carries:

- a lamp 38 with a lamp holder 40 and lamp terminals 42;
- a reed switch 44 with reed switch terminals 46; and
- a pair of light tubes 48 for directing light from the lamp 38 to the panel 12 and then onwards through the diffuser unit 24 to the lens cap 22.

In use, as the lens cap 22 and thus the diffuser unit 24 are pushed down, the vanes 36 of the component 30 are compressed. This causes the housing 32, and thus the magnet 34, to twist relatively to the reed switch 44, causing the reed switch 44 to be operated.

When the push button 20 is released, the resilient nature of the vanes 36 springs the diffuser unit 24 and the lens cap 22 back to their initial positions. This in turn rotates the magnet 34 back to its initial position thereby resetting the reed switch 44.

Figure 4:
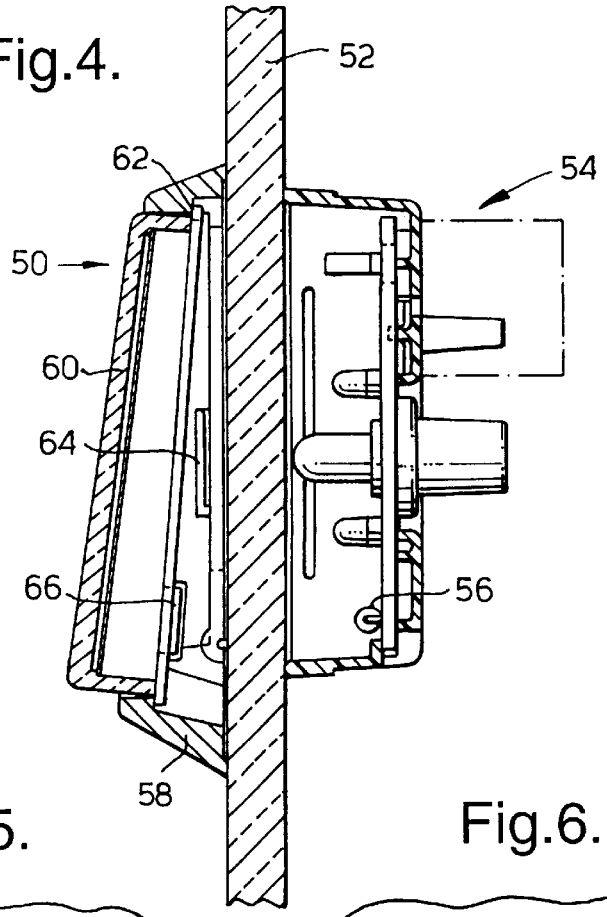
FIG. 4 is a schematic sectional view through a second embodiment.
Figure 5:
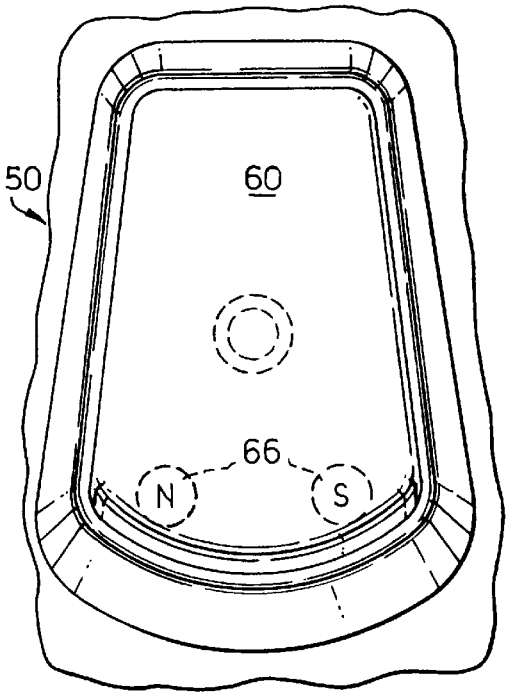
FIGS. 5 and 6 are respectively front and rear views of FIG. 4.
Figure 6:
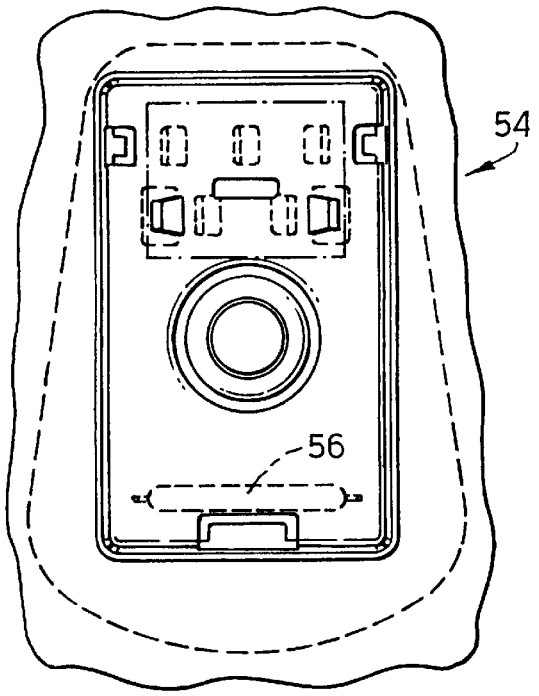

With reference to FIG. 4, an alternative switch assembly is shown which again has a front part 50 located by an outer face of a glass or other insulating panel 52 and a rear part 54 located by an inner face of the panel 52.

The construction of the rear part 54 need not be discussed in detail other than to point out that a reed switch 56 extends perpendicularly to the plane of view with the remainder being a typical lamp assembly, or LED assembly, or IDC connector block assembly (shown in broken outline).

The front part 50 includes:

- a bezel 58;
- a combined lens cap and magnet carrier 60 which is pivotally mounted to the bezel 58 at a pivot 62;
- a compression spring 64; and
- a pair of magnets 66, only one of which can be seen in FIG. 4 because they are spaced apart from one another perpendicularly to the plane of view.

The poles of the two magnets 66 are arranged to face in opposite directions i.e. one has its North pole facing downwards whereas the other has its South pole facing downwards.

The front and rear parts of the switch assembly may be secured to the panel 52 by respective adhesive pads.

In use, as with the embodiment shown in FIGS. 1 to 3, when the combined lens cap and magnet carrier 60 is depressed, it rocks about the pivot 62, causing the spring 64 to be compressed and causing the magnets 66 to operate the reed switch 56.

On release, the spring 64 returns the magnets 66 to their original positions, thus causing the reed switch 56 to be reset.

To reproduce the tactile feel of conventional push buttons, it may be desirable to introduce a suitable feature, such as an over-top-dead-centre mechanism or a snatch mechanism.

An acceptable magnetic switch assembly, including magnets and reed switch, is that available as part no. DCN100886/T from Magnet Developments.

What is claimed is:

1. A switch assembly comprising a panel, a front part located on one face of the panel and a rear part located on an opposed face of the panel, the front and rear parts of the switch assembly being operably connected by magnetic means allowing the panel to extend continuously therebetween;

wherein the front and rear parts of the switch assembly are physically separate from one another, with the front part of the switch assembly being secured to said one face of the panel by adhesive and with the rear part of the switch assembly being secured to said opposed face of the panel by adhesive.

2. A switch assembly according to claim 1, wherein the panel is a glass or plastics panel.

3. A switch assembly according to claim 1, wherein the front part of the switch assembly includes a push button whose movement displaces at least one magnet to cause operation of a reed switch carried by the rear part of the switch assembly.

4. A switch assembly according to claim 3, wherein the push button is movable within a surrounding bezel.

5. A switch assembly according to claim 3, wherein the magnet is constrained to be displaced non-linearly to cause operation of the reed switch.

6. A switch assembly according to claim 5, wherein the magnet is turned relatively to the reed switch.

7. A switch assembly according to claim 6, wherein the magnet remains, whilst being turned, at a substantially constant linear spacing from the reed switch.

8. A switch assembly according to claim 6, wherein the magnet is carried by the push button and a linear displacement of the push button is converted into a turning movement of the magnet by a conversion means.

9. A switch assembly according to claim 8, wherein the conversion means is a collapsible component having a first portion connected to the push button and a second portion connected to the magnet, the first and second portions being connected to each other by a plurality of slanted resilient vanes which cause the magnet to twist relatively to the push button when the distance between the first and second portions is reduced by depressing the push button, and cause the magnet and the push button to be returned to their original positions when the push button is released.

10. A switch assembly according to claim 5, wherein the magnet is rocked relatively to the reed switch.

11. A switch assembly according to claim 10, wherein there are two of the magnets.

* * * * *